United States Patent [19]

Bristol

[11] 4,363,299

[45] Dec. 14, 1982

[54] CRANKLESS INTERNAL COMBUSTION ENGINE

[76] Inventor: Robert D. Bristol, P.O. Box 337, Beulah, Mich. 49617

[21] Appl. No.: 157,870

[22] Filed: Jun. 9, 1980

[51] Int. Cl.[3] ..... F02B 75/32

[52] U.S. Cl. ..... 123/197 AB; 123/197 AC; 123/54 R; 74/53

[58] Field of Search ..... 123/197 R, 197 AB, 197 AC, 123/58 R, 58 A, 56 C, 54 R, 54 B; 74/53, 54

[56] References Cited

U.S. PATENT DOCUMENTS

| | | | |
|---|---|---|---|
| 670,997 | 4/1901 | McLean | 123/197 R |
| 855,256 | 5/1907 | Morey . | |
| 1,089,408 | 3/1914 | Ganderton . | |
| 1,197,591 | 9/1916 | Bargery . | |
| 1,338,311 | 4/1920 | Leonard et al. . | |
| 1,481,727 | 1/1924 | Moore . | |
| 1,505,856 | 8/1924 | Briggs . | |
| 1,537,724 | 5/1925 | Zimmer . | |
| 1,561,826 | 11/1925 | Bremer . | |
| 1,667,213 | 4/1928 | Marchetti . | |
| 1,687,744 | 10/1928 | Webb | 123/197 R |
| 1,873,908 | 8/1932 | Schinke | 123/197 AC |
| 1,885,298 | 11/1932 | Schell | 123/54 B |
| 2,032,495 | 3/1936 | Nuesell | 74/57 |
| 2,294,812 | 9/1942 | Szopieray | 123/195 |
| 2,392,921 | 1/1946 | Holman | 74/44 |
| 2,407,859 | 9/1946 | Wilson | 74/55 |
| 2,477,376 | 7/1949 | Jacobsen | 123/197 AC |
| 2,757,547 | 8/1956 | Julin | 74/131 |
| 3,384,057 | 5/1968 | Boone | 123/51 |
| 3,916,866 | 11/1975 | Rossi | 123/197 R |

*Primary Examiner*—Charles J. Myhre
*Assistant Examiner*—Andrew M. Dolinar
*Attorney, Agent, or Firm*—Price, Heneveld, Huizenga & Cooper

[57] ABSTRACT

A mechanism for converting reciprocating movement of a piston within a cylinder includes a guide defining a closed loop path, an output shaft, and a driven member having a periphery extending along the path. A rod is connected at one end to the piston and has another end moved along the path. The guide has a centerline offset from the centerline of the piston. A drive member engages said driven member as said rod moves along an essentially perpendicular path.

13 Claims, 4 Drawing Figures

CRANKLESS INTERNAL COMBUSTION ENGINE

BACKGROUND OF THE INVENTION

This invention relates to internal combustion engines and more particularly to a mechanism for converting reciprocating movement of a piston to rotating output movement.

Conventional internal combustion engines include at least one cylinder within which a piston reciprocates. The piston is connected to an output crank by an elongated connecting rod pivoted at an upper end to the piston and at a lower end to the crank. An air/fuel mixture is taken into the cylinder, compressed by the piston and ignited by a spark ignition system. As the ignited air/fuel mixture expands, the piston is forced downwardly during the power stroke of the engine. The piston, through the connecting rod, imparts torque to the crank of the crank shaft, causing the crank shaft to rotate.

During the power stroke of a typical engine, the peak pressures within the cylinder are not experienced when the effective moment arm between the piston and the crank is at a maximum. This reduces the efficiency and power output of the engine and is the result of the kinematics inherent in the piston, rod and crank structure. Various proposals have been made to delay the attainment of peak pressures until the piston moves beyond top dead center and the mechanical advantage or torque output is maximized. Such proposals have included apparatus to provide a delayed pressure increase to compensate for combustion chamber volume increase during the power stroke. These approaches are discussed in my earlier application Ser. No. 950,368, filed Oct. 11, 1978, and now U.S. Pat. No. 4,211,082 issued July 8, 1980.

During the operation of conventional internal combustion engines, significant losses or reduction in mechancal advantages occur due to the angular relationships of the piston, connecting rod and conventional crank arm. At top dead center, no torque can be transmitted through the crank. Increased torque and hence a decrease in loss occurs as the engine goes through the power stroke. The useful work obtained is a function of an ever changing amount of pressure within the engine combustion chamber multiplied by the infinitely small distance the piston, rod and crank have moved at each pressure. This is according to the principle of resultant forces which is at work in the process. At the same time, the compound angular application of the pressure causes additional friction on the cylinder walls resulting in additional losses in efficiency. Because these losses are substantial, a need exists for a mechanism which will lessen the angle at which the pressure is applied and increase the distance which the lower end of the connecting rod moves under more favorable torque conditions.

Various attempts have been made to eliminate the conventional connecting rod and crank mechanism to increase the mechanical efficiency or torque output and to reduce other losses caused by the nonlinear movement of the connecting rod during the power stroke. An example of one such proposal may be found in U.S. Pat. No. 1,505,856, entitled EXPLOSIVE MOTOR and issued on Aug. 19, 1924, to Briggs. This patent discloses an internal combustion engine including a piston reciprocating within a cylinder. A crank is offset from the vertical centerline of the piston and is connected to the piston by a vertically moving rod and cam block. The block defines an elongated cam slot within which a crank pin is slidably disposed. The rod is guided for linear, vertical up and down movement. The piston, during the power stroke, applies force to the crank along a line which approaches a perpendicular. Also, offsetting of the cylinder with respect to the crank reduces the side thrust or loading and hence frictional losses.

Other engines wherein a connecting rod moves along in an essentially vertical line and wherein a conventional crank is eliminated may be found in U.S. Pat. No. 1,667,213, entitled INTERNAL COMBUSTION ENGINE and issued on Apr. 24, 1924, to Marchetti; U.S. Pat. No. 2,407,859, entitled MECHANICAL MOVEMENT and issued on Sept. 17, 1946, to Wilson; U.S. Pat. No. 2,757,547, entitled UNIVERSAL DOUBLE TORQUE ENGINE and issued on Aug. 7, 1956, to Julin; and U.S. Pat. No. 3,916,866, entitled ENGINE HAVING RECIPROCATING PISTON AND ROTARY PISTON and issued on Nov. 4, 1975, to Rossi.

SUMMARY OF THE INVENTION

In accordance with the present invention, a unique internal combustion engine including means for increasing the torque output and reducing friction losses is provided. Essentially, the engine includes a cylinder, a piston reciprocating within the cylinder and a connecting rod having an upper end connected to the piston. A lower end of the connecting rod is guided along a vertically extending, closed loop path. An offset output shaft supported within a case is operatively connected to the connecting rod. The lower end of the rod is guided during the power stroke so that it moves along essentially a vertical, perpendicular line. This results in an increase in torque transmitted to the output shaft. Side loading or thrust between the piston and the cylinder wall is minimized during the power stroke which thereby reduces frictional losses. Increased power output and efficiency results.

DETAILED DESCRIPTION OF THE PREFERRED EMBODIMENT

Figure 1:
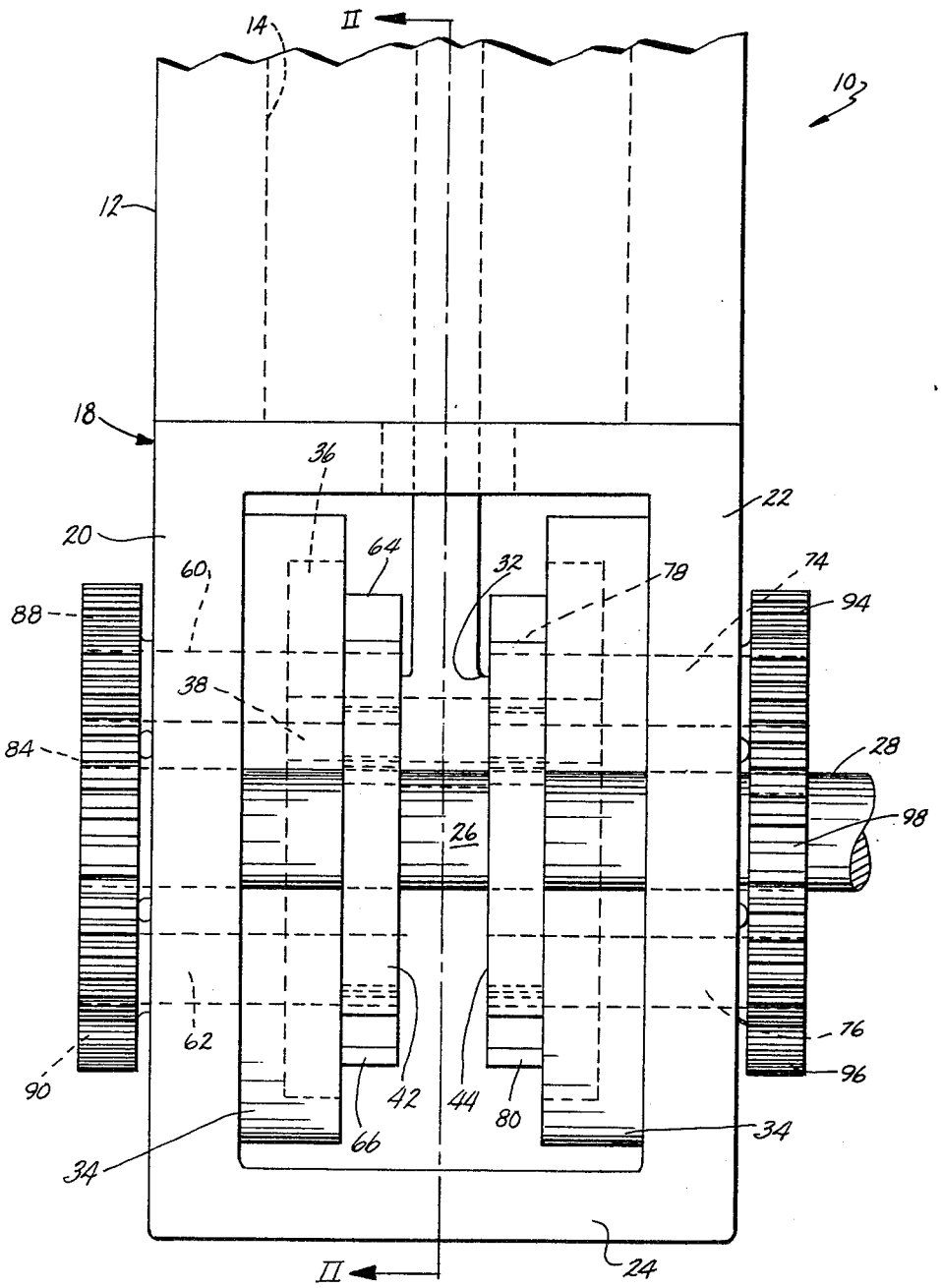
FIG. 1 is a fragmentary, side, elevational view of an internal combustion engine in accordance with the present invention.

A preferred embodiment of a unique internal combustion engine in accordance with the present invention is illustrated in FIG. 1 and generally designated 10. For the sake of simplicity, only a single cylinder engine has been illustrated. Also, conventional details of an internal combustion engine including the lubricating system, the valve train and ignition system have not been illustrated. These may be of a conventional design and are well known to those of ordinary skill in the art. Also, it should be understood that terms such as horizontal and vertical are used herein for convenient reference purposes only. The terms are used to signify essentially perpendicular relationships.

Figure 2:
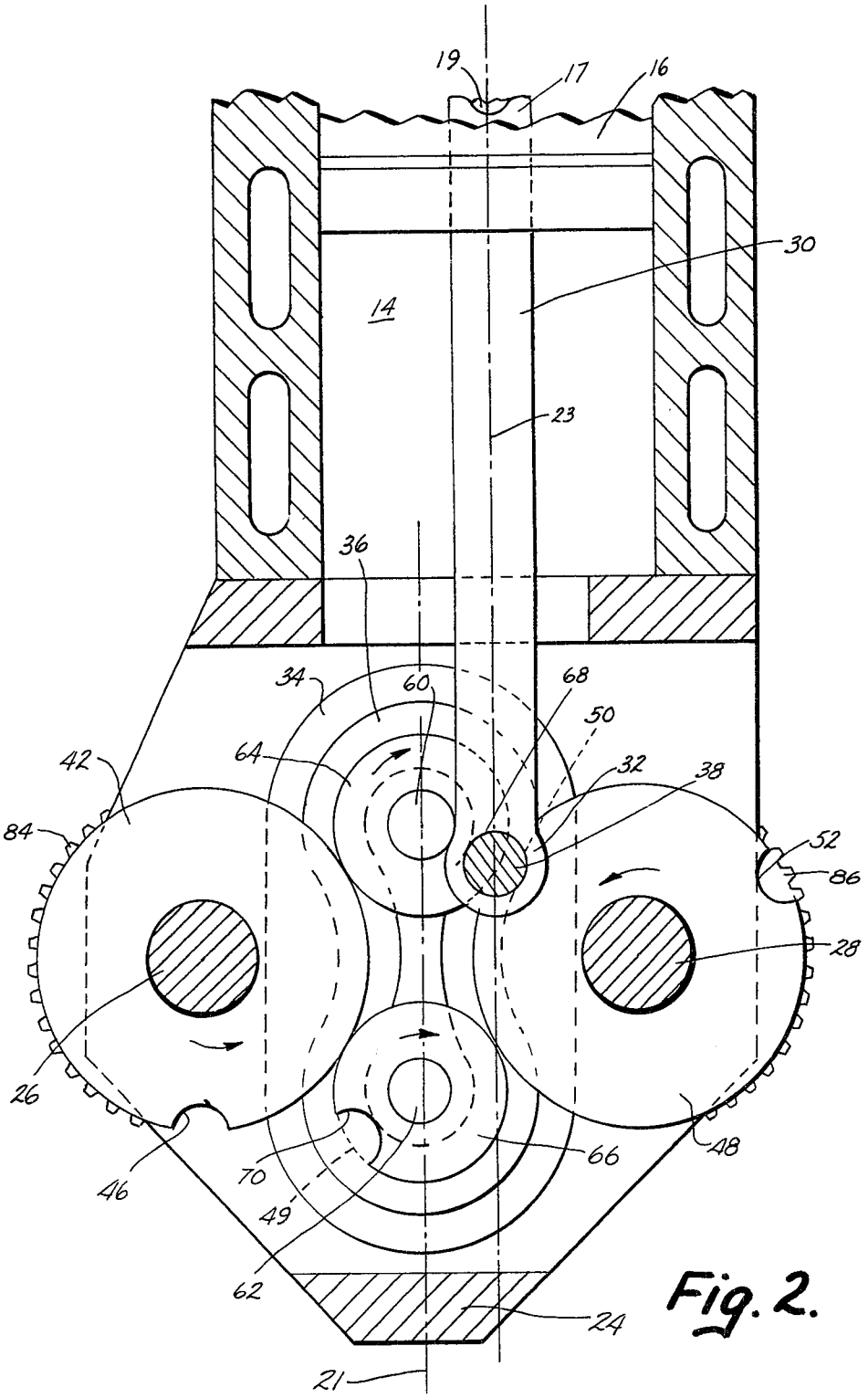
FIG. 2 is a fragmentary, cross-sectional view taken generally along line II—II of FIG. 1.

Engine 10 includes a cylinder block 12 defining a cylinder 14 within which a piston 16 reciprocates (FIG. 2). Cylinder 12 is supported on a case or shaft supporting structure 18. Case 18 includes end support members 20, 22 and a bottom cross member 24.

As best seen in FIG. 2, end members 20, 22 rotatably support a pair of opposed, horizontally positioned and spaced shafts 26, 28. In the embodiment illustrated, shaft 28 is an output shaft driven by a reciprocating piston, as described below.

An elongated rod 30 is pivotally connected at an upper end 17 to piston 16 by a pin 19. The rod extends from the piston downwardly into the case 18. Guide means are provided for guiding a lower end 32 of the rod along a closed, curvilinear, vertically extending path during reciprocating motion of piston 16. As seen in FIGS. 1 and 2, each end member 20, 22 defines or has affixed thereto a guide or cam plate 34. Each plate 34 defines a vertically extending, closed loop cam slot or track 36 having horizontally spaced, essentially vertical runs. Lower end 32 of rod 30 has a pin 38 extending therethrough. Pin 38 is slidably disposed within tracks 36 of cam plates 34. As best seen in FIG. 2, the vertical or longitudinal centerline 21 (FIG. 2) of each plate 34 is offset to one side from the vertical centerline 23 of cylinder 14 and piston 16. Nonrotatably secured to shaft 26 in longitudinally spaced, opposed relationship are a pair of discs or sprockets 42, 44. Sprockets 42, 44 are mirror images of each other and each defines a recess 46 (FIG. 2) opening through its outer periphery. Similarly, output shaft 28 has nonrotatably keyed or secured thereto a pair of mirror image power discs or sprockets 48, only one of which is seen in the drawings. Each sprocket 48 defines a pair of circumferentially spaced recesses 50, 52 opening through its outer periphery. Discs 42, 44 and 48, as seen in FIG. 2, are dimensioned so that their outer peripheries extend along a centerline 49 of cam track 36. As described in further detail below, as piston 16 moves downwardly during the power stroke, pin 38 of rod 30 will move downwardly within track 36 and engage one of recesses 50, 52 of output discs or sprockets 48. As shown in FIG. 2, rod 30 will move downwardly along essentially a vertical line with output shaft 28 offset from the vertical centerline of the cylinder. The torque transmitted to output shaft 28 is increased over that obtained by a conventional crank assembly. Also, the essentially vertical movement of crank 30 during the power stroke reduces or eliminates side thrusts or side loading between the piston and the cylinder wall. This reduces frictional losses during operation of the engine, thereby increasing overall efficiency.

As best seen in FIG. 2, a pair of vertically spaced stub shafts 60, 62 extend through end member 20. Shafts 60, 62 support guide discs or sprockets 64, 66, respectively. Disc 64 defines a semicircular recess 68 opening through its periphery. Similarly, disc 66 defines a semicircular recess 70 opening through its periphery. Shafts 60, 62 are positioned and discs 64, 66 are dimensioned so that the outer diameters of the discs lie along the centerline of cam track 36.

End member 22 similarly supports a pair of vertically spaced stub shafts 74, 76. Shafts 74, 76 are coaxial with shafts 60, 62 and have nonrotatably secured thereto guide discs or sprockets 78, 80 which are mirror images of sprockets 64, 66. The discs on the stub shafts and cams 34 move, guide or direct the rod pin 38 along the guide track 36 during movement of piston 16.

As seen in FIGS. 1 and 2, shafts 26, 28 have synchronizing gears 84, 86 nonrotatably secured thereto exteriorly of case 18. Gears 84, 86 mesh with synchronizing gears 88, 90 nonrotatably secured to shafts 60, 62, respectively. Shafts 74, 76 similarly include synchronizing gears 94, 96 which mesh with gears 98 affixed to shafts 26, 28 exteriorly of end member 22 of case 18. Only one of the gears 98 is illustrated in FIG. 1. The synchronizing gears insure that the discs on shafts 26, 28, 60, 62 and 74, 76 move in a synchronized or timed relationship so that the recesses on the respective discs or sprockets cooperate to receive pin 38 of lower end of connecting rod 30. Sprockets 42, 44, 48, 64, 66, 78 and 80 move the lower end 32 of the connecting rod along the path defined by cam track 36.

OPERATION

With reference to FIG. 2, the operation of the internal combustion engine in accordance with the present invention should be apparent. As illustrated therein, piston 16 is beginning its power stroke and is moving from a top dead center position downwardly towards its bottom dead center or lowermost position within cylinder 14. Sprockets 48, 64 are positioned so that pin 38 is disposed within recesses 68, 50 of the respective sprockets. As piston 16 moves downwardly, pin 38 is guided within cam track 36 and torque is transmitted through disc 48 to output shaft 28. Due to the intermeshing of the synchronizing gears, lower guide sprocket 66 is rotating in a clockwise direction when viewed in FIG. 2. As piston 16 approaches the end of its power stroke, recess 70 will be presented to receive pin 38 and disc 66 will move the pin along the lower end of cam track 36 until it is moved into engagement with recess 46 of disc 42. Disc 42, in cooperation with cam track 36, will then guide and move pin 38 upwardly until the pin is received within recess 68 of disc 64.

During upward movement of piston 16, exhaust gases are removed from the cylinder. Piston 16 moves downwardly in the intake stroke. Piston 16 then moves upwardly to compress the air/fuel mixture which is then ignited and the power stroke is repeated.

Connecting rod 30 moves downwardly during the power stroke along essentially a vertical line so that maximum torque is transmitted to shaft 28 through disc 48. Since the angular relationship which exists between a conventionally cranked piston is eliminated or significantly reduced, increased efficiency for the engine is obtained, as well as an increase in torque output. Fixed cams 34 and discs 64, 66 function and guide the lower end of the piston rod along the predetermined, curvilinear path. Output shaft 28 is offset from the vertical centerline of the cylinder resulting in the increased torque output.

ALTERNATIVE PREFERRED EMBODIMENT

Figure 3:
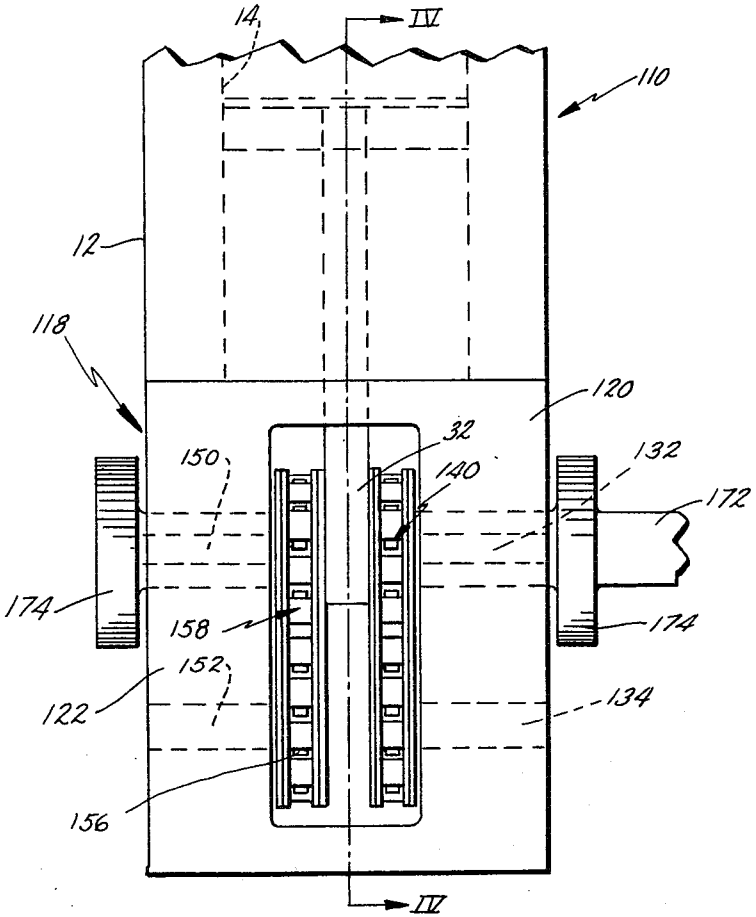
FIG. 3 is a fragmentary, side elevational view of another internal combustion engine in accordance with the present invention.
Figure 4:
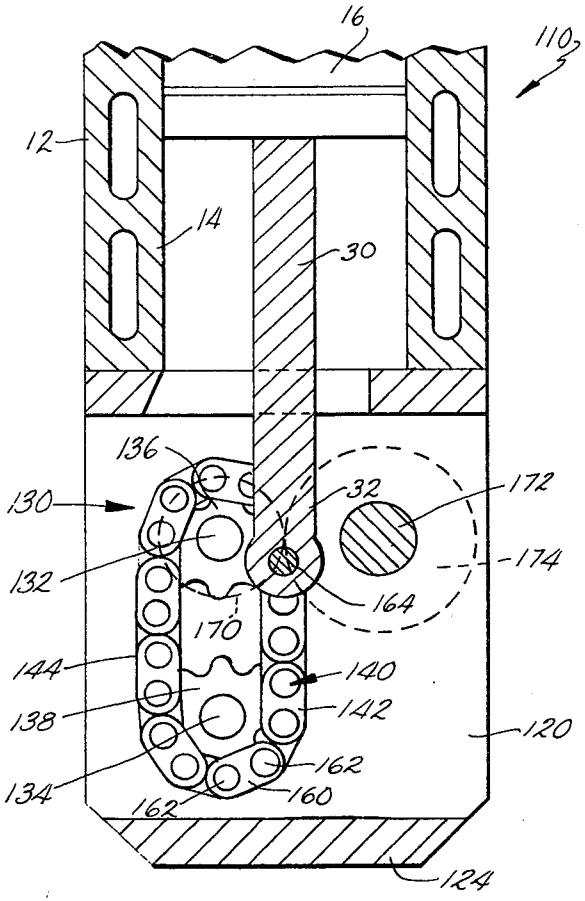
FIG. 4 is a fragmentary, side elevational view taken generally along line IV—IV of FIG. 3.

An alternative preferred embodiment of an internal combustion engine in accordance with the present invention is illustrated in FIGS. 3 and 4 and generally designated 110. In describing engine 110 herein, parts in common with embodiment 10 are designated by like numerals. Engine 110 includes a cylinder block 12 defining a cylinder 14 within which a piston 16 reciprocates. Block 12 is supported and secured to a case or shaft supporting structure 118. Case 118 includes end support members 120, 122 and a bottom cross member 124. As in embodiment 10, an elongated rod 30 has an upper end (not shown) pivotally connected by a suitable wrist pin in a conventional fashion to piston 16. Rod 30 extends downwardly into case 118 and is operatively connected to a guide means 130 at its lower end 32.

As seen in FIGS. 3 and 4, guide means 130 includes a first pair of vertically spaced stub shafts 132, 134 rotatably supported within end wall 120. Nonrotatably secured to the stub shafts are toothed sprockets 136, 138, respectively. An endless roller chain 140 extends around sprockets 136, 138 and defines a first run 142 and a second, horizontally spaced vertical run 144. Similarly, a pair of vertically spaced stub shafts 150, 152 are rotatably supported within end wall 122 in opposed relationship to shafts 132, 134. Nonrotatably secured to stub shafts 150, 152 are toothed sprockets 154, 156, respectively. An endless roller chain 158 extends around sprockets 154, 156. Chain 158 similarly defines horizontally spaced, first and second vertical runs.

Each roller chain, 140, 158 includes side plates 160 joined by pins 162. The lower end 32 of connecting rod 30 has a pin 164 extending therethrough. Pin 164 substitutes for one of the rollers of the roller chains 158, 140 and extends through the side plates of each of the roller chains.

As should be readily apparent, reciprocating movement of piston 16 results in movement of lower end 32 of rod 30 along the closed loop path defined by roller chains 140, 158. During the power stroke, end 32 will move vertically downwardly along the first run of each of the roller chains. As a result of this movement, the connecting rod will transmit torque to sprockets 136, 154 nonrotatably supported on stub shafts 132, 150, respectively. The vertical reciprocating movement of piston 16 is, therefore, converted to rotary movement of the stub shafts.

As seen in FIG. 3 and as schematically illustrated in FIG. 4, each stub shaft 132, 150 has nonrotatably secured thereto a drive gear 170 exteriorly of case 118. Extending through end walls 120, 122 and rotatably suported thereby is an output shaft 172. Output shaft 172 has driven gears 174 nonrotatably secured thereto exteriorly of end walls 120, 122. As schematically illustrated in FIG. 4, the driven gears 174 mesh with drive gears 170 on stub shafts 132, 150. The outer peripheries of the gears 174, 170 extend along and the gears mesh in the same plane as the plane of the centerline of the chains. This is similar to the positioning of the discs on shafts 26, 28 of embodiment 10. As a result, the rotary output movement of the stub shafts is transmitted to output shaft 172.

As with the embodiment illustrated in FIGS. 1 and 2, output shaft 172 is offset from the vertical centerline of cylinder 14 and piston 16. Shaft 172 is, however, in the same horizontal plane as stub shafts 132, 150. The lower end of the connecting rod is guided along a predetermined path defined by the roller chain. Embodiment 110, while being a functional equivalent of embodiment 10, would require an increased stroke over that employed generally in existing engines in order to permit proper selection of the chain to avoid excessive wear and noise in the chain drive. Embodiment 110, however, is of reduced complexity from embodiment 10 since shaft 26 is eliminated along with the disc secured thereto when the cam members are replaced by roller chain and meshing sprockets. With embodiment 110, the connecting rod 30 moves essentially along a perpendicular or vertical line during the power stroke to thereby increase the torque transmitted to output shaft 172 from that obtained by conventionally cranked engines.

Either of the guide means illustrated guides the lower end of the connecting rod through an elliptical-like or oval shaped path or course, the minor radii of which reverse the reciprocal action of the piston. The major radii of the guide path, depending upon the configuration thereof, may be convex or concave lines as illustrated in FIG. 2 or chordal straight lines as illustrated in FIG. 4. That is, the first and second runs of the guide path may be curvilinear or straight parallel lines which are also parallel to the vertical or center axis of the cylinder. The mechanisms illustrated permit the pressure generated in the combustion chamber to be applied by the piston through the lower end of the connecting rod in line with the centerline of the cylinder. This increases the efficiency of the engine by increasing the mechanical advantage during the power stroke and by reducing frictional and other losses which would be encountered in the conventionally cranked engine.

The mechanisms illustrated for converting the reciprocating motion of a piston to rotary output motion are adaptable to existing internal combustion engines. The mechanisms, it is believed, could be manufactured as replacements for the conventional crank presently employed.

In view of the foregoing description, those of ordinary skill in the art might envision various modifications which would not depart from the inventive concepts disclosed herein. It is expressly intended, therefore, that the above description should be considered as that of the preferred embodiments. The true spirit and scope of the present invention may be determined by reference to the appended claims.

The embodiments of the invention in which an exclusive property or privilege is claimed are defined as follows.

1. A mechanism for converting linear reciprocating motion of a member to rotary output movement, said mechanism comprising:

an elongated rod having an upper end and a lower end, said upper end being connected to said member;

guide means operatively connected to said rod lower end for guiding and moving said rod along a path having first and second, horizontally spaced, essentially vertical runs, said guide means including a fixed cam member defining an elongated, closed loop cam track, said lower end of said rod having a pin extending into and riding along said cam track;

an output shaft;

means for rotatably supporting said output shaft adjacent said first run of said guide means and offset from a vertical centerline of said member; and an output means secured to said output shaft and having an outer periphery extending along said first run for operatively connecting said output shaft to said elongated rod lower end so that torque is transmitted to said output shaft as said rod moves along said first essentially vertical run as said member reciprocates.

2. A mechanism for converting linear reciprocating motion of a member to rotary output movement, said mechanism comprising:

an elongated rod having an upper end and a lower end, said upper end being connected to said member;

guide means operatively connected to said rod lower end for guiding and moving said rod along a path having first and second, horizontally spaced, essentially vertical runs;

an output shaft;

means for rotatably supporting said output shaft adjacent said first run of said guide means and offset from a vertical centerline of said member; and an output means secured to said output shaft and having an outer periphery extending along said first run for operatively connecting said output shaft to said elongated rod lower end so that torque is transmitted to said output shaft as said rod moves along said first essentially vertical run as said member reciprocates, wherein said guide means comprises:

a cam member defining an elongated, closed loop cam track, said lower end of said rod having a pin riding along said track, and wherein said guide means further includes:

another shaft positioned in horizontally spaced relationship to said output shaft, said output means comprising:

an output sprocket secured to said output shaft and having an outer periphery extending along said first run, said output shaft being driven by said rod as said member reciprocates; and another sprocket secured to said another shaft, said another sprocket dimensioned the same as said output sprocket and having a periphery extending along said second run, said output sprocket and said another sprocket defining semicircular recesses opening through their peripheries for receiving said pin as said pin moves along said closed loop cam track.

3. A mechanism as defined by claim 2 wherein said guide means further includes:

a pair of vertically spaced stub shafts adjacent upper and lower ends of said cam track, said stub shafts being within the path defined by said cam track;

a first guide disc secured to one of said stub shafts; and a second guide disc secured to the other of said stub shafts, said guide discs defining recesses for receipt of said pin.

4. A mechanism as defined by claim 3 further including:

timing means operatively engaging said sprockets and said discs for rotating said sprockets and said discs in timed relationship so that the recesses receive said pin as said pin moves along said cam track.

5. An internal combustion engine of the type including a cylinder, a piston reciprocal within the cylinder, an elongated rod having an upper end connected to the piston and a lower end, and driven means operatively connected to the lower end of the rod for converting reciprocating movement of the piston and rod to rotary output movement, said driven means comprising:

guide means operatively connected to the lower end of the rod for guiding and moving the lower end of said rod along a predetermined, generally vertical, closed loop path having first and second, horizontally spaced, essentially vertical runs, said guide means including a fixed cam member fixed with respect to said cylinder and which defines an elongated, closed loop cam track, said rod lower end having a pin extending into and riding along said cam track so that said lower end moves along said cam track;

an output shaft;

means for rotatably mounting said output shaft adjacent said first run of guide means and offset from a vertical centerline of said cylinder and said piston;

a generally circular driven member on said output shaft, said driven member having an outer periphery extending along said first run of said guide means; and drive means engaging said driven member for rotating said driven member as said rod lower end moves from a first position to a second position along said cam track during a power stroke of said engine so that torque is transmitted to said output shaft as said rod moves along said first essentially vertical run as said piston reciprocates.

6. An internal combustion engine of the type including a cylinder, a piston reciprocal within the cylinder, a rod having an upper end connected to the piston and driven means operatively connected to the lower end of the rod for converting reciprocating movement of the piston and rod to rotary output movement, said driven means comprising:

guide means engaging the lower end of the rod for guiding movement of the lower end along a predetermined, generally vertical, closed loop path;

an output shaft;

means for rotatably mounting said output shaft adjacent said guide means and offset from a vertical centerline of said cylinder;

a generally circular driven member on said output shaft; and drive means engaging said driven member for rotating said driven member as said rod moves from a first position to a second position during a power stroke of said engine, said guide means comprising a cam member comprising an elongated curvilinear cam track, said lower end of said rod including an elongated pin riding within said track, and wherein said circular driven member comprises a disc fixed to said output shaft and defining recesses opening through the outer periphery of said disc at circumferentially spaced points on said disc, said recesses being positioned to be engaged by said pin as said piston reciprocates, and said driven means further includes another shaft supported in spaced opposed, horizontal relationship to said output shaft.

7. An internal combustion engine as defined by claim 6 wherein said guide means further comprises:

a pair of vertically spaced guide discs rotatably mounted by a pair of stub shafts, one of said stub shafts being at the upper end and one of said stub shafts being at the lower end of said cam track, each of said discs defining a recess opening through its periphery;

another disc fixed to said another horizontally spaced shaft and defining a recess opening through its periphery, said a recess of said another disc dimensioned to receive said pin as said piston reciprocates; and timing means operatively connecting said shafts, said stub shafts and said discs for rotation in a timed relationship as said piston reciprocates, said pin engaging said output disc, said guide discs and said another disc at said recesses as said pin is guided and moved along said curvilinear path.

8. An internal combustion engine as defined by claim 7 wherein said timing means comprises:

a plurality of intermeshed gears, one mounted on each of said shafts, whereby rotation of said output shaft rotates the remaining shafts and discs in a timed relationship.

9. An internal combustion engine as defined by claim 8 wherein said elongated curvilinear cam track has a vertical centerline offset from the vertical centerline of the piston so that said pin engages said driven member during essentially vertical downward movement of said rod lower end.

10. An internal combustion engine as defined by claim 9 further including:

another cam member defining another cam track having the same configuration as said cam track, said another cam member being positioned in longitudinally, spaced and opposed relationship to said cam member, said pin also riding within the cam track of said another cam member.

11. An internal combustion engine as defined by claim 10 further including another driven disc secured to said output shaft adjacent said another cam member, said another driven disc defining a recess engaged by said pin during the power stroke of said engine.

12. An internal combustion engine as defined by claim 11 further including rotary means adjacent said another cam track for guiding said pin during movement from a lowermost position to an uppermost position.

13. An internal combustion engine as defined by claim 11 further including another timing means operatively connecting said another driven disc and said rotary means for causing said another driven disc and said rotary means to rotate in timed relationship.

* * * * *